US005862225A

United States Patent [19]

Feldman et al.

[11] Patent Number: 5,862,225

[45] Date of Patent: Jan. 19, 1999

[54] AUTOMATIC RESYNCHRONIZATION FOR REMOTE KEYLESS ENTRY SYSTEMS

[75] Inventors: Andrea M. Feldman, Farmington Hills; Steven R. Settles, Sterling Heights, both of Mich.

[73] Assignee: UT Automotive Dearborn, Inc., Dearborn, Mich.

[21] Appl. No.: 766,071

[22] Filed: Dec. 16, 1996

[51] Int. Cl.[6] ..... H04K 1/00

[52] U.S. Cl. ..... 380/48; 380/23; 380/49; 340/825.69

[58] Field of Search ..... 380/48, 49, 42, 380/21; 340/825.69; 395/186, 187.4, 188.01; 375/295, 316

[56] References Cited

U.S. PATENT DOCUMENTS

| | | | |
|---|---|---|---|
| 4,825,210 | 4/1989 | Bachhuber et al. | 340/825.31 |
| 5,369,706 | 11/1994 | Latka | 380/23 |
| 5,646,996 | 7/1997 | Latka | 380/21 |

*Primary Examiner*—Gail O. Hayes
*Assistant Examiner*—Christopher S. Hawthorne
*Attorney, Agent, or Firm*—Ozer M. N. Teitelbaum

[57] ABSTRACT

The present invention teaches a method and system for resynchronizing a remote keyless entry receiver having received a new encrypted message transmitted by the transmitter which does not match a previous encrypted message, also transmitted by the transmitter, and stored in memory. The method comprises a first step of transmitting and receiving a first new follow up encrypted message. Subsequently, the received new encrypted message is re-encrypted, and that result is tested against the received first new follow up encrypted message to determine whether there is a match. In the event both match, a second new follow up encrypted message transmitted and received. At this point, the received re-encrypted new encrypted message is re-encrypted a second time, and that result is tested against the received second new follow up encrypted message to determine whether there is a further match. If a match is made, the received second new follow up encrypted message is decrypted and the command within the received and decrypted second new follow up encrypted message is initiated.

13 Claims, 2 Drawing Sheets

AUTOMATIC RESYNCHRONIZATION FOR REMOTE KEYLESS ENTRY SYSTEMS

FIELD OF THE INVENTION

This invention relates to secure systems, generally, and more particularly a remote keyless entry encryption algorithm.

BACKGROUND OF THE INVENTION

In the automotive industry, remote keyless entry ("RKE") systems have become standard equipment on many new vehicles. Comprising a receiver within the car and a number of fob transmitters for transmitting a message to the receiver, RKE systems enable users to control several vehicle functions remotely, such as the door locks and trunk, for example.

In providing remote control to vehicle functions, a problem arises as to restricting remote access to the automobile's owners and other authorized users. To prevent unauthorized access, an identification system is incorporated with a security code or codes within both the fob transmitter and receiver. The receiver receives a transmitted signal having a command and an identification or security code and compares the received code with the security code stored in its memory. If the receiver determines the received security code to match the stored code, the command is initiated for execution.

As the demand for RKE systems has evolved in the marketplace, greater emphasis has been placed on increased security, reliability and flexibility. With the development of sophisticated electronics, presently, a transmitted message may be decoded and retransmitted at a later time. This is in part because in these known systems the transmitted message does not change between transmissions.

One area of focus has been the incorporation of encryption techniques into RKE system to decrease the likelihood of unauthorized reception and retransmission of the originally transmitted signal comprising both a command and a security code. Security by encryption may be accomplished using an algorithm in the transmitter for manipulating data into random or "rolling" codes. As a result of such an encryption algorithm, each code transmitted will be different from the last, making it difficult for the code to be copied and the vehicle security defeated.

However, in utilizing an encryption scheme, it is also necessary that the transmitter and receiver remain in synchronization with each other. If the transmitter and receiver are asynchronized, the transmitted command residing within an encrypted message will not be initiated by the receiver. A resultant rolling code, as calculated by the receiver and transmitter utilizing such an encryption scheme, must be equivalent to initiate a received command.

The issue of synchronization is of particular relevance in certain circumstances. First, if a user inadvertently enables the transmission of a rolling code encrypted command while the transmitter is out of range, the transmitter will be at least one encryption step ahead of the receiver. Further, should either transmitter or receiver suffer a power loss, the unaffected component will be at least one encryption step ahead of the receiver. Moreover, the system may be asynchronized if the user uses an alternate transmitter. This situation arises in the event several transmitters are supplied with a single receiver or if one transmitter is damaged and a replacement transmitter is supplied.

Therefore, there is a demand for a method and system for resynchronizing a transmitter that is asynchronized with a receiver generally. Moreover, a need further exists for an RKE system having utilizing such a method and system for resynchronizing an asynchronized RKE transmitter with an RKE receiver.

SUMMARY OF THE INVENTION

In order to achieve the advantages of the present invention, a method of resynchronizing a remote keyless entry receiver having received a new encrypted message transmitted by the transmitter which does not match a previous encrypted message, also transmitted by the transmitter, and stored in memory is disclosed. The method comprises a first step of transmitting and receiving a first new follow up encrypted message. Subsequently, the received new encrypted message is re-encrypted, and that result is tested against the received first new follow up encrypted message to determine whether there is a match. In the event both match, a second new follow up encrypted message transmitted and received. At this point, the received re-encrypted new encrypted message is re-encrypted a second time, and that result is tested against the received second new follow up encrypted message to determine whether there is a further match. If a match is made, the received second new follow up encrypted message is decrypted and the command within the received and decrypted second new follow up encrypted message is initiated.

In a further embodiment of the present invention, a system is disclosed for resynchronizing a receiver with a transmitter if the receiver and the transmitter are asynchronized. The system comprises a first memory device for storing an old encrypted message transmitted by the transmitter and received by the receiver, as well as a second memory device for storing a new encrypted message transmitted by the transmitter and received by the receiver. The system further comprises a microcomputer for re-encrypting the old encrypted message, and for testing whether the re-encrypted old message matches the new message. If the new message matches the re-encrypted old message, the microcomputer decrypts the new message and initiates a command within the decrypted new message. If, however, the new message does not match the re-encrypted old message, the microcomputer re-encrypts the re-encrypted old message, and decrements a counter each time the re-encrypted old message is re-encrypted. While the counter exceeds a count number, the microcomputer tests whether the new message matches the re-encrypted old message. Where a match is made, the new message is decrypted and the command within the decrypted new message is initiated by the microcomputer. On the other hand, if the new message does not match the re-encrypted old message and the counter exceeds the count number, the steps of re-encrypting the re-encrypted old message, decrementing the counter, and testing whether the new message matches the re-encrypted old message are repeated. However, if the counter does not exceed the count number, the microcomputer receives a first new follow up encrypted message transmitted by the transmitter, re-encrypting the new message, and tests whether the first new follow up message matches the re-encrypted new message. In the event that the first new follow up message matches the re-encrypted new message, the microcomputer receives a further new follow up encrypted message transmitted by the transmitter, re-encrypts the re-encrypted new message, and tests whether the further new follow up message matches the twice re-encrypted new message. Should the further new follow up message match the twice re-encrypted new message, the microcomputer decrypts the further new follow up message and initiates the command within the further new follow up message.

These and other advantages and objects will become apparent to those skilled in the art from the following detailed description read in conjunction with the appended claims and the drawings attached hereto.

BRIEF DESCRIPTION OF THE DRAWINGS

The present invention will be better understood from reading the following description of non-limitative embodiments, with reference to the attached drawings, wherein below.

It should be emphasized that the drawings of the instant application are not to scale but are merely schematic representations and are not intended to portray the specific parameters or the structural details of the invention, which can be determined by one of skill in the art by examination of the information herein.

DETAILED DESCRIPTION OF THE PREFERRED EMBODIMENT

Figure 1:
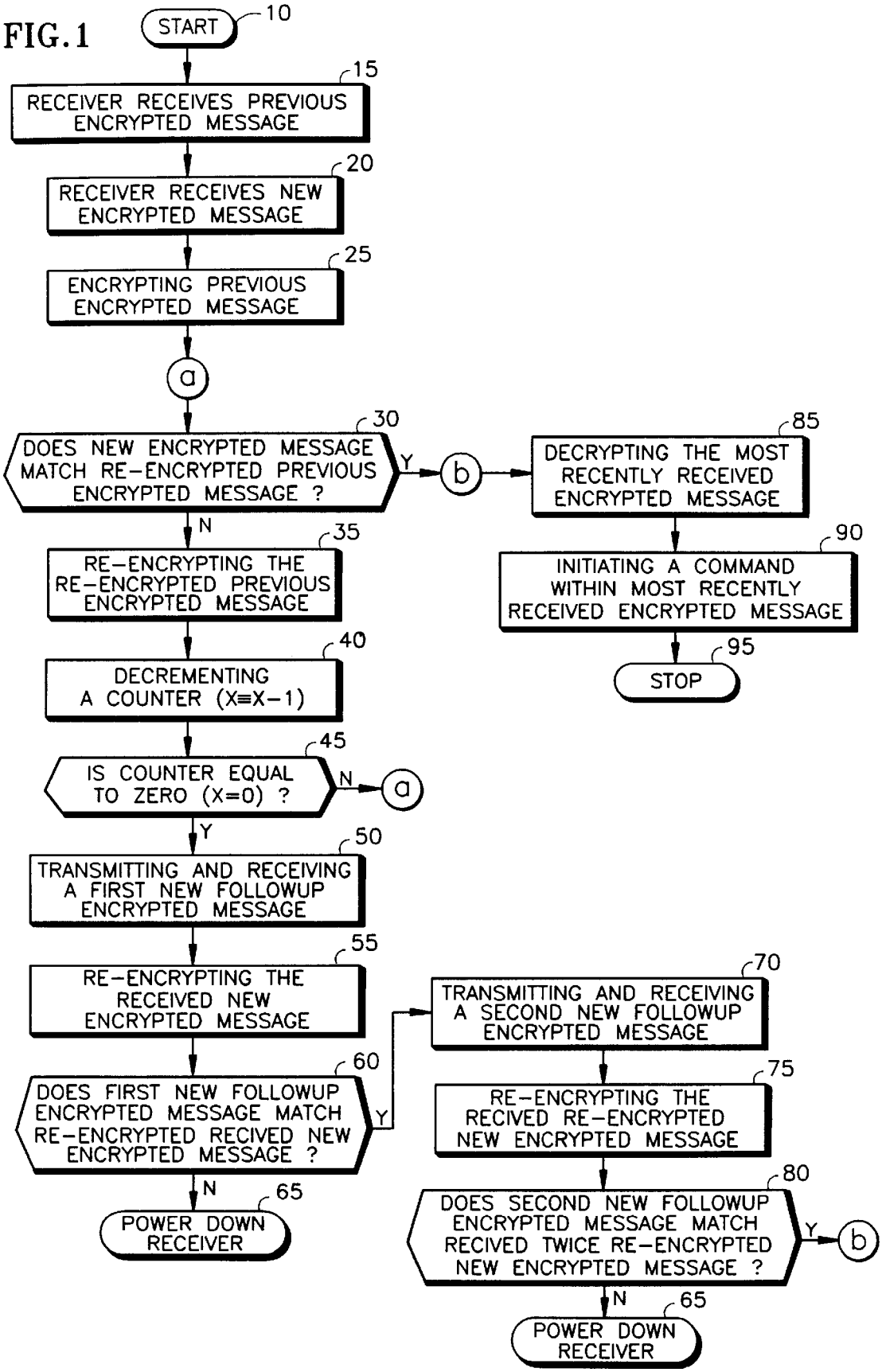
FIG. 1 illustrates a flow chart of a first embodiment of the present invention.

Referring to FIG. 1, a flow chart of a method of resynchronizing a transmitter with a receiver if the both are not properly synchronized. Upon initiating the algorithm (START 10), the receiver receives a encrypted message, labeled "previous message", from the transmitter (PREVIOUS MESSAGE RECEIVED 15). At this point the operation of the RKE system, both transmitter and receiver are synchronized. At a later time, a new encrypted message transmitted by the transmitter is received by the receiver (NEW MESSAGE RECEIVED 20).

To determine whether the RKE system is synchronized properly, the step of re-encrypting the previous message is performed (RE-ENCRYPT PREVIOUS MESSAGE 25). So long as the encryption algorithm is deterministic, the next encrypted value of the previous message will equal the subsequently received new message if both transmitter and receiver are synchronized. As such, the method test whether the re-encrypted previously received message matches the just received new message (TEST 30). In the event that a match is made, the RKE system deems that both transmitter and receiver are synchronized. As a result, the new message is decrypted (DECRYPT MESSAGE 85), the command residing within the most recently received message, in this case the new message, is initiated (INITIATE COMMAND 90), and the algorithm complete (STOP 95).

On the other hand, if the re-encrypted previously received message does not match the just received new message, the method performs a preliminary check to see if the recently received new message is authentic. Here, the already re-encrypted previous message is re-encrypted once again (RE-ENCRYPT RE-ENCRYPTED PREVIOUS MESSAGE 35). Subsequently, a count number within a counter is decremented by one (DECREMENT COUNTER 50). In the preferred embodiment of the present invention, the count number is preset to 256, though it should be apparent that other numbers may be substituted therefor.

Upon decrementing the counter, the process subsequently tests whether the count number has reached zero (TEST 45). If the count number does not equal zero, the control of the algorithm is returned to the step of determining whether the re-encrypted previously received message matches the just received new message (TEST 30). This loop is executed in an attempt to test whether the transmitter is authentic, as well as to ascertain whether the new transmitted message falls within a window of encrypted results. Thus, the method examines whether the recently received message as transmitted by the transmitter is encrypted a certain number, or count number, of times ahead of the previously received message in the receiver.

As such, the method, once again, if a match is made, the new message is decrypted (DECRYPT MESSAGE 85), the command residing within the more recently received message, in this case the new message, is initiated (INITIATE COMMAND 90), and the algorithm completed (STOP 95). In contrast, if a match is not made, the already twice re-encrypted previous message is re-encrypted once again (RE-ENCRYPT RE-ENCRYPTED PREVIOUS MESSAGE 35), and the count number within the counter is decremented by one (DECREMENT COUNTER 50) and a test is performed to determine whether the count number has reached zero (TEST 45). It should be apparent to one of ordinary skill in the art, as a result of this configuration, the algorithm performs this loop in the proper circumstances a maximum total of number times equal to the initial count number.

In the event the count number is determined to be equal to zero, the method determines that both receiver and transmitter need to be resynchronized. Here, a first new follow up encrypted message is transmitted by the transmitter and received by the receiver (FIRST NEW FOLLOW UP MESSAGE RECEIVED 50). Once the first new follow up message is received, the algorithm re-encrypts the previously received new message (RE-ENCRYPT THE NEW MESSAGE 55). It should be noted that this step encompasses the step of setting the previous message to the new message by writing over the contents of the previous message with the new message. Thereafter, a test is performed to determine whether the first new follow up message matches the re-encrypted new message (TEST 60).

In the event a match is made between the first new follow up message and the re-encrypted new message, the method calls for the transmission by the transmitter and reception by the receiver of a second new follow up encrypted message (SECOND NEW FOLLOW UP MESSAGE RECEIVED 70). Subsequently, the re-encrypted new message is re-encrypted an additional time (RE-ENCRYPT THE RE-ENCRYPTED NEW MESSAGE 75). Once the re-encrypted new message is re-encrypted, a test is performed to determine whether the second new follow up message matches the twice re-encrypted new message (TEST 80). If a match is made at this point, the new message is decrypted (DECRYPT MESSAGE 85), the command residing within the most recently received message, in this case the second follow up message, is initiated (INITIATE COMMAND 90), and the algorithm completed (STOP 95). At this point, both receiver and transmitter have been resynchronized.

On the other hand, if the second new follow up message does not match the twice re-encrypted new message, the receiver is powered down for a period of time (POWER DOWN RECEIVER 65). Likewise, if the first new follow up message fails to match the re-encrypted new message, the receiver is powered down for a period of time (POWER DOWN RECEIVER 65).

In the preferred embodiment of the present invention, it should be noted, that a third and a fourth new follow up message are required to match a continuously further re-encrypted new message before the resynchronization takes place. Accordingly, the third new follow up message is transmitted and received, the twice re-encrypted new message is re-encrypted a third time, and the third new follow up message is tested against the three times re-encrypted new message for a match. If no match is made, as detailed hereinabove, the receiver is powered down for a period of time (POWER DOWN RECEIVER 65). If a match is made, the fourth new follow up message is transmitted and received, the three times re-encrypted new message is re-encrypted yet another time, and the fourth new follow up message is tested against the four times re-encrypted new message for a match. Once again, if the fourth new follow up message does not match the four times re-encrypted new message, the receiver is powered down for a period of time (POWER DOWN RECEIVER 65). If both the fourth new follow up message and the four times re-encrypted new message do match, the transmitter and receiver are deemed to have been resynchronized and a fifth message is transmitted and received. The fifth message is decrypted, the command contained therein is subsequently initiated, and the algorithm completed.

Figure 2:
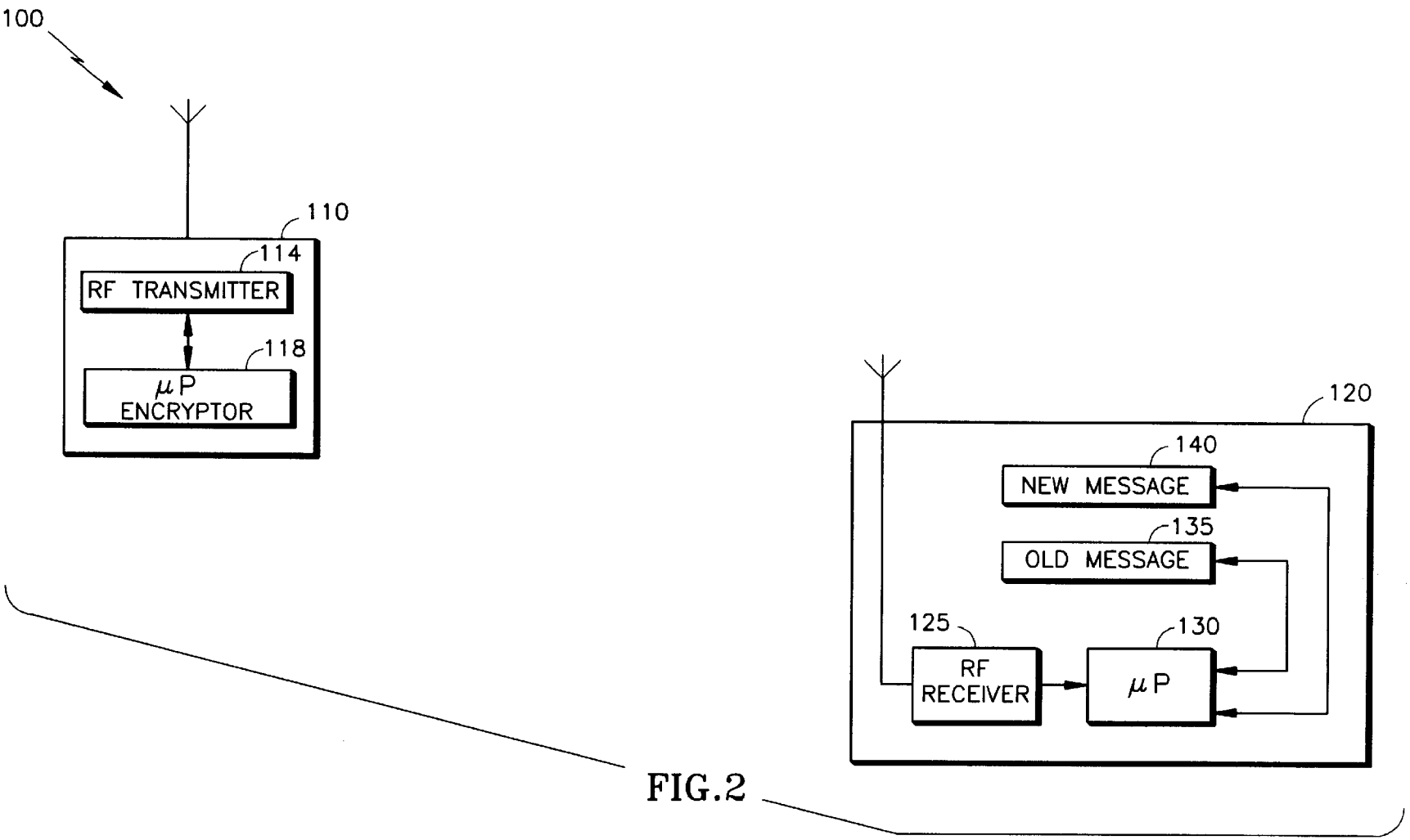
FIG. 2 illustrates a block diagram of a second embodiment of the present invention.

Referring to FIG. 2, a second embodiment of the present invention, a resynchronization system 100, is illustrated. System 100 comprises a transmitter 110 having a radio frequency ("RF") transmitter section 114 including an antenna for transmitting messages. Moreover, transmitter 110 additionally comprises a microcomputer 118 for performing various functions, including encrypting messages.

System 100 further comprises a receiver 120 for receiving the encrypted messages transmitted by transmitter 110. The reception of these messages is primarily the responsibility of an RF receiver section 125 within receiver 120. RF receiver section 125 is coupled with a microcomputer 130. In turn, microcomputer 130 is coupled with both an old message memory device 135 and a new message memory device 140. In the preferred embodiment, system 100 is employed in a RKE system, and as such, receiver 120 is located within the vehicle.

Functionally, receiver 120 receives an encrypted message, labeled "previous message", from transmitter 110. This previous message is stored in old message memory device 135. At this point the operation of the RKE system, both transmitter and receiver are synchronized. At a later time, a new encrypted message transmitted by transmitter 110 is received by receiver 120 which is stored in new message memory device 140.

Microcomputer 130 determines whether the resynchronization algorithm is required. First, microcomputer 130 re-encrypts the previous message stored in old message memory device 135. Subsequently, microcomputer 130 tests whether the re-encrypted previous message matches the new message stored in new message memory device 140. If a match is made, the microcomputer concludes no resynchronization is necessary, and as a result, decrypts the new message and initiates the command within the decrypted message.

On the other hand, if the re-encrypted previous message does not match the new message stored in new message memory device 140, microcomputer re-encrypts the re-encrypted previous message. Upon re-encrypting the re-encrypted previous message, microcomputer 130 decrements a counter, preferably located within microcomputer 130. While the counter exceeds a count number, microcomputer 130 tests whether the new message matches the re-encrypted previous message. Where a match is made, the new message is decrypted and the command within the decrypted new message is initiated by microcomputer 130.

If, however, a match is not made between the new message and the multiple times re-encrypted previous message, microcomputer 130 loops back to re-encrypt the re-encrypted previous message and decrement the counter. It should be apparent to one of ordinary skill that the re-encrypted previous message is re-encrypted during each loop. Thereafter, microcomputer 130 tests whether the new message matches the re-encrypted previous message.

In the event that, after decrementing the counter, the count number is deemed to be zero, microcomputer 130 executes a resynchronization routine. This routine requires microcomputer 130 to receive a first follow up encrypted message from transmitter 110 through RF receiver section 125. Once received, microcomputer 130 re-encrypts the new message. This is realized by first setting the new message to be equal to the previous message. In so doing, the contents of new message memory device 140 are written into old message memory device 135. Thereafter, microcomputer 130 tests for a match between the re-encrypted new message and the first follow up message.

In the event a match is made between the first new follow up message and the re-encrypted new message, microcomputer 130 receives a second new follow up encrypted message. In the preferred embodiment, the second follow up message is transmitted automatically by transmitter 110. In a further embodiment of the present invention, both transmitter 110 and receiver 120 are transceivers, and at this point receiver 120 transmits a feedback status message to transmitter 110 notifying transmitter 110 that a second follow up message is required.

Subsequent to receiving the second follow up message, microcomputer 130 re-encrypts the re-encrypted new message an additional time and tests whether the second new follow up message matches the twice re-encrypted new message. If a match is made, microcomputer 130 decrypts the new message, initiates the command residing within the most recently received message, in this case the second follow up message, and the algorithm completed. At this point, both receiver and transmitter have been resynchronized.

On the other hand, if the second new follow up message fails to match the twice re-encrypted new message, microcomputer 130 powers down receiver 120 for a period of time. Likewise, if microcomputer 130 determines that the first new follow up message does not match the re-encrypted new message, receiver 120 is powered down for a period of time.

In the preferred embodiment of the present invention, it should be noted, that a third and a fourth new follow up message are required to match a continuously further re-encrypted new message before the resynchronization takes place. Accordingly, the third new follow up message is transmitted by transmitter 110 and received by receiver 120, and microcomputer 130 re-encrypts the twice re-encrypted new message for a third time. Thereafter, the third new follow up message is tested against the three times re-encrypted new message by microcomputer 130 for a match. If no match is made, as detailed hereinabove, microcomputer 130 powers down receiver 120 for a period of time. However, if a match is made, the fourth new follow up message is transmitted by transmitter 110 and received by receiver 120, and microcomputer 130 re-encrypts the three times re-encrypted new message yet another time. As detailed hereinabove, microcomputer 130 subsequently tests the fourth new follow up message against the four times re-encrypted new message for a match. If the fourth new follow up message does not match the four times re-encrypted new message, microcomputer 130 powers down receiver 120 for a period of time. If the fourth new follow up message and the four times re-encrypted new message do match, microcomputer 130 deems transmitter 110 and receiver 120 to have been resynchronized and a fifth message is transmitted by transmitter 110 and received by receiver 120. Microcomputer 130 subsequently decrypts the fifth message, the command contained therein is subsequently initiated, and the algorithm completed.

It should be apparent to one of ordinary skill in the art that the encryption method employed in both transmitter 110 and receiver 120 must be identical to execute a command. Various encryption techniques may be utilized in this regard including linear and non-linear rolling code algorithms. The essential point in selecting an encryption process, however, is that predictability of the result.

It should also be noted that reference to term message hereinabove shall mean either a single code set or, as in the preferred embodiment, a pair of code sets.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. Thus, for example, it should be apparent to one of ordinary skill in the art that the security system of the present invention may be applied in conjunction with enclosed spaces which inhibit entry and/or exit such as a vehicle, door, building entrance, safe, desk drawer or jail cell, and the like. The invention detailed herein is, hence, applicable to other secured enclosed spaces or secured switching mechanisms requiring security for deterring theft. Moreover, the present invention is also applicable to key formats requiring the storage of personal or secured information thereon. It is therefore contemplated that the appended claims will cover any such modifications or embodiments as fall within the true scope of the invention.

All of the U.S. patents cited herein are hereby incorporated by reference as if set forth in their entirety.

What is claimed is:

1. A method of resynchronizing a receiver with a transmitter if the receiver and the transmitter are asynchronous, the receiver having received a new encrypted message, the method comprising the steps:

transmitting and receiving a first new follow up encrypted message;

re-encrypting the received new encrypted message;

testing whether said received first new follow up encrypted message matches the re-encrypted received new encrypted message; and if said received first new follow up encrypted message matches the re-encrypted received new encrypted message, transmitting and receiving a further new follow up encrypted message;

re-encrypting the received re-encrypted new encrypted message;

testing whether said received further new follow up encrypted message matches said received twice re-encrypted new encrypted message; and if said received further new follow up encrypted message matches the received twice re-encrypted new encrypted message, decrypting said received further new follow up encrypted message; and initiating a command within said received and decrypted further new follow up encrypted message.

2. The invention of claim 1, further comprising the step of:

powering down the receiver if said received first new follow up encrypted message does not match the re-encrypted received new encrypted message or if said received further new follow up encrypted message does not match the received twice re-encrypted new encrypted message.

3. The invention of claim 2, wherein said the receiver is powered down for a period of time.

4. The invention of claim 1, further comprising the steps of:

if said received first new follow up encrypted message matches the re-encrypted received new encrypted message, transmitting and receiving a second new follow up encrypted message;

re-encrypting the received re-encrypted new encrypted message;

testing whether said received second new follow up encrypted message matches said received twice re-encrypted new encrypted message; and if said received second new follow up encrypted message matches the received twice re-encrypted new encrypted message, transmitting and receiving a third new follow up encrypted message;

re-encrypting the received twice encrypted new encrypted message;

testing whether said received third new follow up encrypted message matches said received three times encrypted new encrypted message; and if said received third follow up encrypted message matches the received three times encrypted new encrypted message, transmitting and receiving a fourth new follow up encrypted message;

re-encrypting the received three times encrypted new encrypted message;

testing whether said received fourth new follow up encrypted message matches said received four times encrypted new encrypted message; and if said received fourth new follow up encrypted message matches said received four times encrypted new encrypted message, transmitting and receiving a fifth new follow up encrypted message;

re-encrypting the received four times encrypted new encrypted message;

testing whether said received fifth new follow up encrypted message matches said received five times encrypted new encrypted message; and if said received fifth new follow up encrypted message matches said received five times encrypted new encrypted message, decrypting said received fifth new follow up encrypted message; and initiating a command within said received and decrypted further fifth new follow up encrypted message.

5. A method of resynchronizing a remote keyless entry receiver with a transmitter, the receiver having received a previous encrypted message, the method comprising the steps:

receiving a new encrypted message from the transmitter;

re-encrypting the previous encrypted message;

testing whether said received new encrypted message matches said re-encrypted previous encrypted message;

if said received new encrypted message matches said re-encrypted previous encrypted message, decrypting said received new encrypted message;

initiating a command within said decrypted new message;

if said received new encrypted message does not match said re-encrypted previous encrypted message, re-encrypting said re-encrypted previous encrypted message;

decrementing a counter each time said re-encrypted previous encrypted message is re-encrypted;

if said counter exceeds a count number, testing whether said received new encrypted message matches said re-encrypted previous encrypted message;

if said received new encrypted message matches said re-encrypted previous encrypted message, decrypting said received new encrypted message;

initiating said command within said decrypted new message;

if said received new encrypted message does not match said re-encrypted previous encrypted message, repeating the steps of re-encrypting said re-encrypted previous encrypted message, decrementing the counter, and testing whether said new encrypted message matches said re-encrypted previous encrypted message if said counter exceeds said count number;

if said counter does not exceed said count number, transmitting and receiving a first new follow up encrypted message;

re-encrypting said received new encrypted message;

testing whether said received first new follow up encrypted message matches said re-encrypted received new encrypted message;

if said received first new follow up encrypted messages matches said re-encrypted received new encrypted message, transmitting and receiving a further new follow up encrypted message;

re-encrypting said received re-encrypted new encrypted message;

testing whether said received further new follow up encrypted messages matches said received twice re-encrypted new encrypted message;

if said received further new follow up encrypted message matches said received twice re-encrypted new encrypted message, decrypting said received further new follow up encrypted message; and initiating said command within said received further new follow up encrypted message.

6. The invention of claim 5, further comprising the step of:

powering down the receiver if said received first new follow up encrypted message does not match the re-encrypted received new encrypted message or if said received further new follow up encrypted message does not match the received twice re-encrypted new encrypted message.

7. The invention of claim 6, wherein the receiver is powered down for a period of time.

8. The invention of claim 5, further comprising the steps of:

if said received first new follow up encrypted message matches the re-encrypted received new encrypted message, transmitting and receiving a second new follow up encrypted message;

re-encrypting the received re-encrypted new encrypted message;

testing whether said received second new follow up encrypted message matches said received twice re-encrypted new encrypted message; and if said received second new follow up encrypted message matches the received twice re-encrypted new encrypted message, transmitting and receiving a third new follow up encrypted message;

re-encrypting the received twice encrypted new encrypted message;

testing whether said received third new follow up encrypted message matches said received three times encrypted new encrypted message; and if said received third follow up encrypted message matches the received three times encrypted new encrypted message, transmitting and receiving a fourth new follow up encrypted message;

re-encrypting the received three times encrypted new encrypted message;

testing whether said received fourth new follow up encrypted message matches said received four times encrypted new encrypted message; and if said received fourth new follow up encrypted message matches said received four times encrypted new encrypted message, transmitting and receiving a fifth new follow up encrypted message;

re-encrypting the received four times encrypted new encrypted message;

testing whether said received fifth new follow up encrypted message matches said received five times encrypted new encrypted message; and if said received fifth new follow up encrypted message matches said received five times encrypted new encrypted message, decrypting said received fifth new follow up encrypted message; and initiating a command within said received and decrypted further fifth new follow up encrypted message.

9. A system for resynchronizing a receiver with a transmitter if the receiver and the transmitter are asynchronized, the system comprising:

a first memory device for storing an old encrypted message transmitted by the transmitter and received by the receiver;

a second memory device for storing a new encrypted message transmitted by the transmitter and received by the receiver;

a microcomputer for re-encrypting said old encrypted message, for testing whether said re-encrypted old message matches said new message, if said new message matches said re-encrypted old message, for decrypting said new message; and for initiating a command within said decrypted new message; and if said new message does not match said re-encrypted old message, for re-encrypting said re-encrypted old message;

for decrementing a counter each time said re-encrypted old message is re-encrypted;

for testing whether said counter exceed a count number; and if said count number exceeds said zero, for testing whether said new message matches said re-encrypted old message;

if said new message matches said re-encrypted old message, for decrypting said new message;

for initiating said command within said decrypted new message; and if said new message does not match said re-encrypted old message, for repeating the steps of re-encrypting said re-encrypted old message, for decrementing the counter, and for testing whether said new encrypted message matches said re-encrypted old message if said counter exceeds said count number; and if said counter number does not exceed zero, for transmitting and receiving a first new follow up encrypted message;

for re-encrypting said new message;

for testing whether said first new follow up message matches said re-encrypted new message; and if said first new follow up encrypted message matches said re-encrypted new message, for transmitting and receiving a further new follow up encrypted message;

for re-encrypting said re-encrypted new message;

for testing whether said further new follow up message matches said twice re-encrypted new message; and if said further new follow up message matches said twice re-encrypted new message, for decrypting said further new follow up message; and for initiating said command within said further new follow up message.

10. The invention of claim 9, wherein at least one of said first and second memory devices comprise at least one of random access memory ("RAM") and electrical erasable programmable read only memory ("EEPROM").

11. The invention of claim 9, wherein said microcomputer powers down the receiver if said first new follow up message does not match said re-encrypted new message or if said further new follow up message does not match said twice re-encrypted new message.

12. The invention of claim 11, wherein the receiver is powered down for a period of time.

13. The invention of claim 9, wherein said microcomputer further tests whether said first new follow up message matches said re-encrypted new message, and if said received first new follow up encrypted message matches the re-encrypted new message, said microcomputer receives a second new follow up encrypted message transmitted from the transmitter;

said microcomputer re-encrypts said re-encrypted new message;

said microcomputer tests whether said second new follow up message matches said twice re-encrypted new message; and if said second new follow up message matches said twice re-encrypted new message, said microcomputer receives a third new follow up encrypted message transmitted by the transmitter;

said microcomputer re-encrypts said twice encrypted new message;

said microcomputer tests whether said third new follow up message matches said three times encrypted new message; and if said received third follow up encrypted message matches said three times encrypted new message, said microcomputer receives a fourth new follow up encrypted message transmitted by the transmitter;

said microcomputer re-encrypting said three times encrypted new message;

said microcomputer tests whether said received fourth new follow up message matches said four times encrypted new message; and if said fourth new follow up encrypted message matches said four times encrypted new message, said microcomputer receives a fifth new follow up encrypted message transmitted by the transmitter;

said microcomputer re-encrypts said four times encrypted new message;

said microcomputer tests whether said fifth new follow up message matches said five times encrypted new message; and if said received fifth new follow up message matches said five times encrypted new message, said microcomputer decrypts said fifth new follow up message; and said microcomputer initiates a command within said decrypted further fifth new follow up encrypted message.

* * * * *